US006978744B2

(12) United States Patent
Yuasa et al.

(10) Patent No.: US 6,978,744 B2
(45) Date of Patent: Dec. 27, 2005

(54) TWO-CYCLE COMBUSTION ENGINE WITH AIR SCAVENGING SYSTEM

(75) Inventors: Tsuneyoshi Yuasa, Kobe (JP); Masanori Kobayashi, Kobe (JP)

(73) Assignee: Kawasaki Jukogyo Kabushiki Kaisha, Hyogo (JP)

( * ) Notice: Subject to any disclaimer, the term of this patent is extended or adjusted under 35 U.S.C. 154(b) by 0 days.

(21) Appl. No.: 10/862,661

(22) Filed: Jun. 7, 2004

(65) Prior Publication Data

US 2004/0244738 A1 Dec. 9, 2004

(30) Foreign Application Priority Data

Jun. 9, 2003 (JP) ..... 2003-163108

(51) Int. Cl.[7] ..... F02B 33/04
(52) U.S. Cl. ..... 123/73 PP; 123/73 A
(58) Field of Search ..... 123/73 PP, 73 A, 123/65 R, 73 V

(56) References Cited

U.S. PATENT DOCUMENTS 6,257,179 B1 * 7/2001 Uenoyama et al. ..... 123/65 R
6,279,521 B1 * 8/2001 Ishida et al. ..... 123/73 PP
6,418,891 B2 * 7/2002 Kobayashi ..... 123/73 PP

FOREIGN PATENT DOCUMENTS

JP 2000-179346 6/2000
JP 2001-193557 7/2001

* cited by examiner

*Primary Examiner*—Henry C. Yuen
*Assistant Examiner*—Hyder Ali

(57) ABSTRACT

The two-cycle combustion engine includes a first scavenge passage (12) for communicating directly between a combustion chamber (1*a*) and a crank chamber (2*a*), a second scavenge passage (14) for communicating the combustion chamber (1*a*) and the crank chamber (2*a*) through a bearing (81) for a crankshaft (8), an air supply passage (10) for introducing air (A) into the second scavenge passage (14), a reed valve (15) provided in the air supply passage (10), and an air-fuel mixture supply passage (11) for introducing an air-fuel mixture (M) into the crank chamber (2*a*). The second scavenge passage (14) is positioned at a location nearer to an exhaust port (12*a*) than the first scavenge passage (13). An air introducing passage (16) is formed in an cylinder block (1) so as to communicate the air supply passage (10) with the second scavenge passage (14) by way of a radially outer portion of the first scavenge passage (13).

5 Claims, 12 Drawing Sheets

TWO-CYCLE COMBUSTION ENGINE WITH AIR SCAVENGING SYSTEM

CROSS-REFERENCE TO THE RELATED APPLICATIONS

United State Patent Application entitled "Two-cycle Combustion Engine" and filed even day herewith in the United States with the Convention priorities based on the Japanese Patent Application Nos. 2003-163108 filed on Jun. 9, 2003 and 2003-177509 filed on Jun. 23, 2003, the filing number of which has not yet been allocated.

BACKGROUND OF THE INVENTION

1. Field of the Invention

The present invention generally relates to a two-cycle combustion engine of an air scavenging type suitable for use as a power plant for a compact work machine such as, for example, a bush cutter or mowing machine.

2. Description of the Prior Art

The two-cycle combustion engine of the type referred to above has hitherto been well known, in which prior to the air-fuel mixture introduced into the combustion chamber to scavenge the latter, preparatory scavenging with air takes place to suppress a blow-off of a portion of the air-fuel mixture outwardly through the exhaust port together with combustion gases. Specifically, the conventional two-cycle combustion engine of this type includes first and second scavenge passages each defined in part in the engine cylinder and in part in the crankcase so that air can be once introduced into the second scavenge passage and then supplied into the combustion chamber through the second scavenge passage prior to the air-fuel mixture being supplied into the combustion chamber through the first scavenge passage during the power and exhaust stroke.

In this conventional two-cycle combustion engine, the second scavenge passage is fluid connected by means of a connecting tube and clamps with an air supply passage through which the air is introduced from the outside of the combustion engine, for example, from the atmosphere by way of an air cleaner unit. Because of this, the number of component parts such as the connecting tube and clamps as well as the number of assembling steps increases, resulting in reduction in productivity and increase in manufacturing cost.

On the other hand, the Japanese Laid-open Patent Publication No. 2001-193557 discloses another conventional two-cycle combustion engine of the structure, in which an air supply chamber is defined in the wall of the engine cylinder adjacent an air intake system and is fluid connected with a pair of air branch passages defined also in the wall of the engine cylinder so that the preparatory scavenging can be accomplished with air supplied from the air supply chamber. This conventional two-cycle combustion engine is advantageous in that the number of component parts such as the connecting tube and the clamp can be reduced considerably, and the number of assembling steps can also be reduced, accompanied by increase in productivity.

However, in the case of the conventional two-cycle combustion engine disclosed in the above mentioned patent publication, the air branch passages in the wall of the engine cylinder are each formed by means of a molding technique utilizing dies or molds of a complicated shape. In other words, referring to FIG. 4 of the above mentioned patent publication it is clear that the air branch passages in the wall of the engine cylinder are each formed so as to extend from the air supply chamber with their respective longitudinal axis inclined relative to the longitudinal axis of the engine cylinder and, therefore, the use of the dies or molds of a complicated shape is essential during the dies molding process. Considering that the dies or molds of a complicated shape are generally expensive, the two-cycle combustion engine disclosed in the above mentioned patent publication obviously requires increase of the manufacturing cost.

SUMMARY OF THE INVENTION

Accordingly, the present invention is intended to provide an improved two-cycle combustion engine having an air scavenging system, in which scavenge passage necessary to accomplish the air scavenging can be formed with the use of dies or molds of a simplified structure and in which the number of component parts and the number of assembling steps can also be reduced with the manufacturing cost reduced consequently.

In order to accomplish the foregoing object, the present invention provides a two-cycle combustion engine having an air scavenging system, which includes first and second scavenge passages each communicating between a combustion chamber and a crank chamber, an air supply passage for supplying air, an air introducing passage for introducing the air from the air supply passage towards the second scavenge passage, a reed valve disposed in the air supply passage, and an air-fuel mixture supply passage for supplying an air-fuel mixture into the crank chamber. The second scavenge passage is positioned at a location nearer to an exhaust port than the first scavenge passage. The air introducing passage referred to above is formed in the engine cylinder so as to introduce the air from the air supply passage into the second scavenge passage by way of a radially outer portion of the first scavenge passage. A recess defining the air introducing passage is formed in the engine cylinder together with casting of the engine cylinder.

The two-cycle combustion engine of the structure described above is so designed and so operable that during the intake and compression stroke, the air from the air supply passage can be introduced into the second scavenge passage through the reed valve and the air-fuel mixture from the air-fuel mixture supply passage can be introduced into the crank chamber, but during the scavenge stroke, supply of the air within the second scavenge passage into the combustion chamber can be initiated prior to initiation of supply of the air-fuel mixture within the crank chamber into the combustion chamber through the first scavenge passage.

According to the present invention, the second scavenge passage is positioned at a location nearer to the exhaust port than the first scavenge passage and, during the scavenge stroke, supply of the air within the second scavenge passage into the combustion chamber can be initiated prior to the air-fuel mixture being introduced from the first scavenge passage into the combustion chamber.

Accordingly, the air-fuel mixture supplied into the combustion chamber during the scavenge stroke can advantageously be blocked by the air already present within the combustion chamber and in the vicinity of the exhaust port, to thereby avoid the blow-off of a portion of the air-fuel mixture supplied into the combustion chamber. At this time, the reed valve is opened during the subsequent intake and compression stroke to allow the air within the air supply passage to be introduced into the second scavenge passage. In other words, so long as the reed valve is opened during the intake and compression stroke with a negative pressure consequently developed within the crank chamber, the air is introduced into the second scavenge passage at all time and, accordingly, a sufficient amount of air can be secured within the second scavenge passage.

Also, the provision of the air introducing passage for introducing the air within the air supply passage into the second scavenge passage, which is defined in the engine cylinder so as to extend radially outwardly of the first scavenge passage is effective to eliminate the need to use the connecting tube and clamps for connecting between the air supply passage and the second scavenge passage and, hence, effective to reduce the number of component parts and the number of assembling steps required. Also, since the air introducing passage is defined by the recess that is formed together with casting of the engine cylinder, the air introducing passage can be formed easily with the use of a die or mold of a simplified shape and, accordingly, the cost of manufacture of the two-cycle combustion engine can advantageously be reduced.

In a preferred embodiment of the present invention, the two-cycle combustion engine may also include an insulator interposed between a carburetor and the engine cylinder, which insulator is formed integrally with a protrusion extending into the recess in the engine cylinder to define a portion of the wall surface of the air introducing passage.

According to this feature, the wall surface of the air introducing passage is defined by the recess and the protrusion of the insulator protruding into such recess, the recess in the engine cylinder can have a simplified shape and, hence, a casting mold used to form the air introducing passage in the engine cylinder can have a correspondingly simplified shape, resulting in minimization of the cost needed to prepare the mold. Also, the volume of the recess communicated with the crank chamber can be reduced by the protrusion so formed and, therefore, a high air injection pressure can advantageously be secured during the scavenge stroke.

In another preferred embodiment of the present invention, the two-cycle combustion engine may also include a lid member fitted to the engine cylinder and forming a part of the wall surface of the air introducing passage. According to this structural feature, since the air introducing passage is formed by the engine cylinder and the lid member, the mold needed to form the air introducing passage in the engine cylinder can have a simplified shape and a similarly simplified structure, resulting in minimization of the cost for preparing the die or mold.

In a further preferred embodiment of the present invention, the insulator interposed between the carburetor and the insulator may be formed with a pair of branch passages that define a downstream portion of the air supply passage, and the reed valve has a pair of selective open/close areas defined therein for selectively opening and closing the corresponding branch passages. According to this structural feature, since the reed valve is operable to selectively open and close the associated branch passages each having a small sectional surface area, the stroke between open and closed positions can be minimized. Accordingly, the combustion engine incorporating the reed valve can advantageously be manufactured in a compact size.

In a still further preferred embodiment of the present invention, the second scavenge passage may be fluid connected between the combustion chamber and the crank chamber through a bearing for a crankshaft supported by the crankcase. According to this structural feature, when a portion of the air-fuel mixture introduced into the crank chamber is ready to enter the second scavenge passage during the scavenge stroke, the air-fuel mixture can flow through the bearing for the crankshaft and, therefore, the bearing for the crankshaft can advantageously be lubricated with a simplified structure.

BRIEF DESCRIPTION OF THE DRAWINGS

In any event, the present invention will become more clearly understood from the following description of preferred embodiments thereof, when taken in conjunction with the accompanying drawings. However, the embodiments and the drawings are given only for the purpose of illustration and explanation, and are not to be taken as limiting the scope of the present invention in any way whatsoever, which scope is to be determined by the appended claims. In the accompanying drawings, like reference numerals are used to denote like parts throughout the several views, and:

DETAILED DESCRIPTION OF THE EMBODIMENTS

Hereinafter, preferred embodiments of the present invention will be described in detail with reference to the accompanying drawings.

Figure 1:
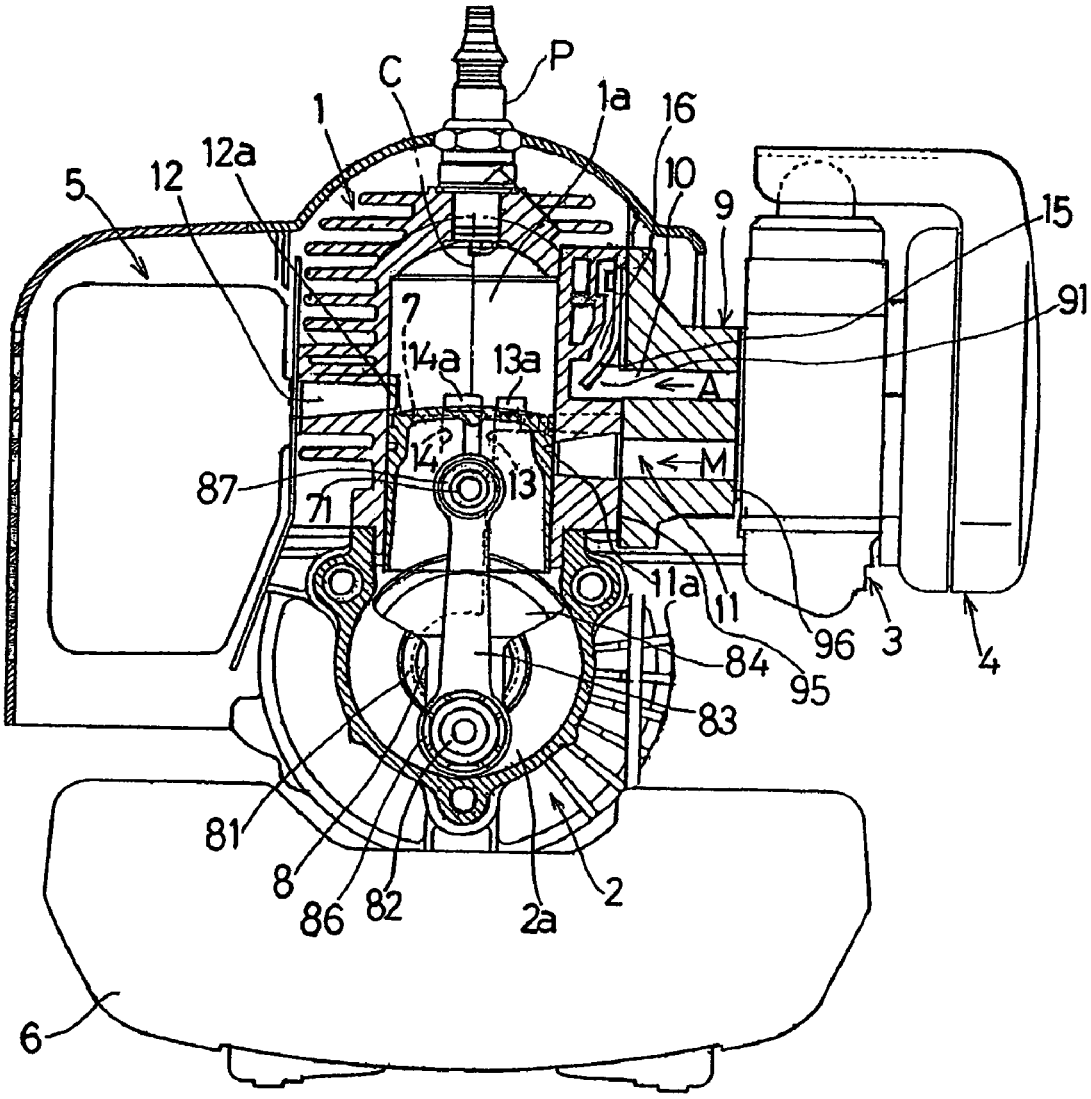
FIG. 1 is an elevational view in section of a two-cycle internal combustion engine according to a preferred embodiment of the present invention.

Referring first to FIG. 1, the two-cycle internal combustion engine shown therein includes an engine cylinder block 1 having a combustion chamber 1*a* defined therein and an ignition plug P mounted atop the cylinder block 1, and a crankcase 2 on which the cylinder block 1 is fixedly mounted. The cylinder block 1 and the crankcase 2 are made of a metallic material such as aluminum and are formed by a metal casting process in a manner well known to those skilled in the art. The cylinder bore in the cylinder block 1 accommodates therein a piston 7 for reciprocating movement in a direction axially thereof, which piston 7 cooperates with the cylinder bore to define a capacity-variable combustion chamber 1*a*.

A carburetor 3 and an air cleaner unit 4, forming respective parts of an air intake system of the two-cycle internal combustion engine are fluid connected with a side wall portion, for example, a right side wall portion of the cylinder block 1 while a muffler 5 forming a part of an exhaust system of the same engine is connected with a left side wall portion of the cylinder block 1. A fuel tank 6 is secured to a bottom portion of the crankcase 2. A crankshaft 8 is rotatably mounted on the crankcase 2 by bearings 81. This crankshaft 8 includes a hollow crankpin 82 positioned at a location offset radially from the longitudinal axis thereof. A connecting rod 83 having big and small ends opposite to each other is drivingly connected at its big end with the crankpin 82 by means of a bearing 86, while the small end of the connecting rod 83 is drivingly connected with a hollow piston pin 71, carried by the reciprocating piston 7, by means of a bearing 87. The crankshaft 8 also includes crank webs 84 on respective sides of the crankpin 82.

An insulator 9 is interposed between the cylinder block 1 and the carburetor 3 through sealing gaskets 95 and 96 so that the carburetor 3 can be thermally insulated from the cylinder block 1 to minimize transmission of heat of an elevated temperature from the cylinder block 1 to the carburetor 3. This insulator 9 has an upper portion formed with an air supply passage 10 defined therein and a lower portion formed with an air-fuel mixture supply passage 11 defined therein so as to extend parallel to the air supply passage 10. The air-fuel mixture supply passage 11 extending from the carburetor 3 has an air-fuel mixture supply port 11*a* opening in the cylinder bore of the cylinder block 1.

The carburetor 3 includes a single rotary valve operable to adjust the cross sectional surface area of both of the air supply passage 10 and the air-fuel mixture supply passage 11. The cylinder block 1 has an exhaust passage 12 defined therein and communicated with the combustion chamber 1*a* within the cylinder block 1 through an exhaust port 12*a* which opens in the inner peripheral surface of the cylinder block 1 at a location spaced substantially 180° from the air-fuel mixture supply port 11*a* around the longitudinal axis of the cylinder block 1. Exhaust gases (combustion gases) generated within the combustion chamber 1*a* can be exhausted to the outside through this exhaust passage 12 by way of the muffler 5.

A first scavenge passage 13 for directly fluid connecting between the combustion chamber 1*a* and a crank chamber 2*a* is formed in part in the cylinder block 1 and in part in the crankcase 2. A second scavenge passage 14 for fluid connecting between the combustion chamber 1*a* and the crank chamber 2*a* through one of the bearings 81 for the crankshaft 8 is formed in part in the cylinder block 1 and in part in the crankcase 2 and positioned nearer to the exhaust port 12*a* than the first scavenge passage 13.

Figure 3:
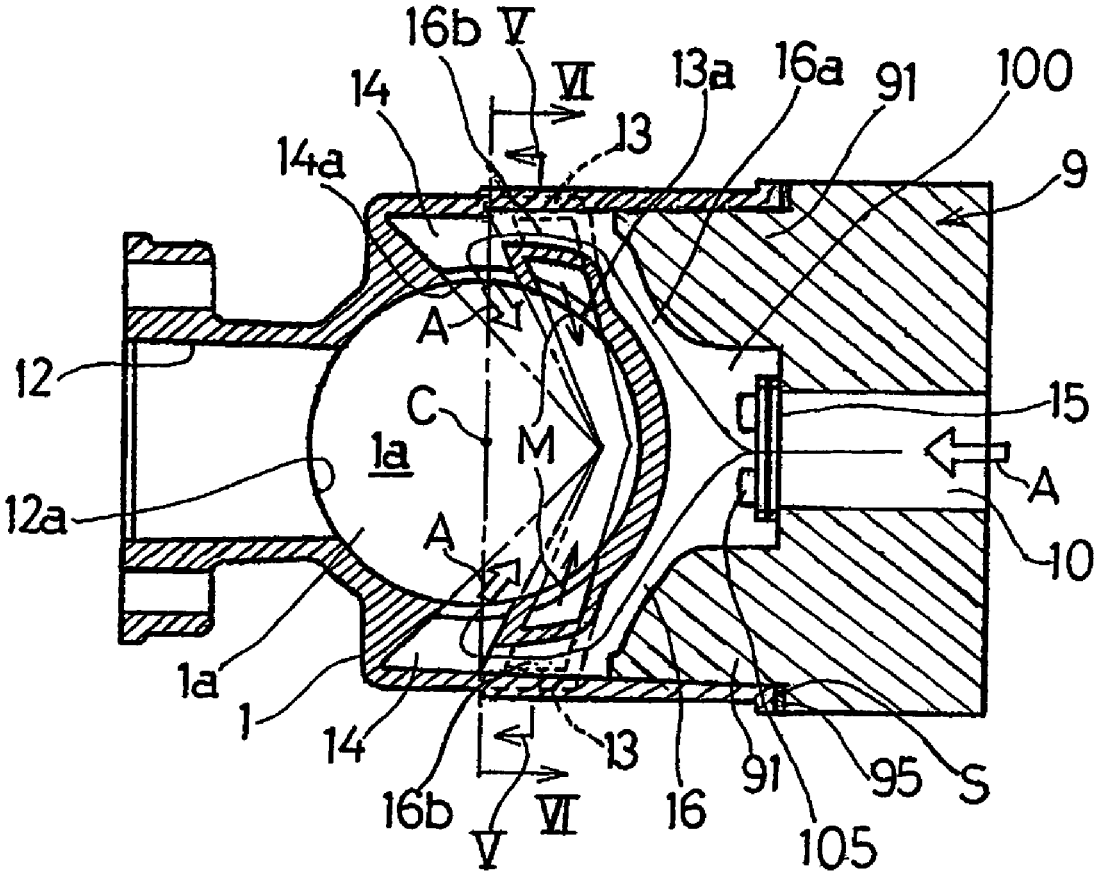
FIG. 3 is a cross-sectional view taken along line III—III in FIG. 2.

It is to be noted that the first and second scavenge passages 13 and 14 are employed in two pairs one pair on each side of the longitudinal axis of the exhaust passage 12 as best shown in FIG. 3 and that those pairs of the first and second scavenge passages 13 and 14 are arranged symmetrical to each other with respect to the longitudinal axis of the exhaust passage 12.

Also, the first and second scavenge passages 13 and 14 have their upper ends communicated with the cylinder bore of the cylinder block 1 through respective first and second scavenge ports 13*a* and 14*a*. The first and second scavenge ports 13*a* and 14*a* are so defined and so positioned relative to each other that, as best shown in FIG. 2, the topmost edge portion of the second scavenge port 14*a* can be held at a level higher than that of the topmost edge portion of the first scavenge port 13*a*, but lower than that of the topmost edge portion of the exhaust port 12*a*.

An air A flowing through the air supply passage 10 in the insulator 9 is once introduced into the second scavenge passage 14 through an air introducing passages 16, as will be described later with reference to FIG. 3, by the effect of a negative pressure developed within the crank chamber 2*a* as the piston 7 ascends during the intake and compression stroke. On the other hand, an air-fuel mixture M containing oil and flowing through the air-fuel mixture supply passage 1 is directly introduced into the crank chamber 2*a* through the air-fuel mixture supply port 11*a*, defined in the inner peripheral surface of the cylinder block 1, by the effect of the negative pressure developed within the crank chamber 2*a* as the piston 7 ascends during the intake and compression stroke.

Figure 2:
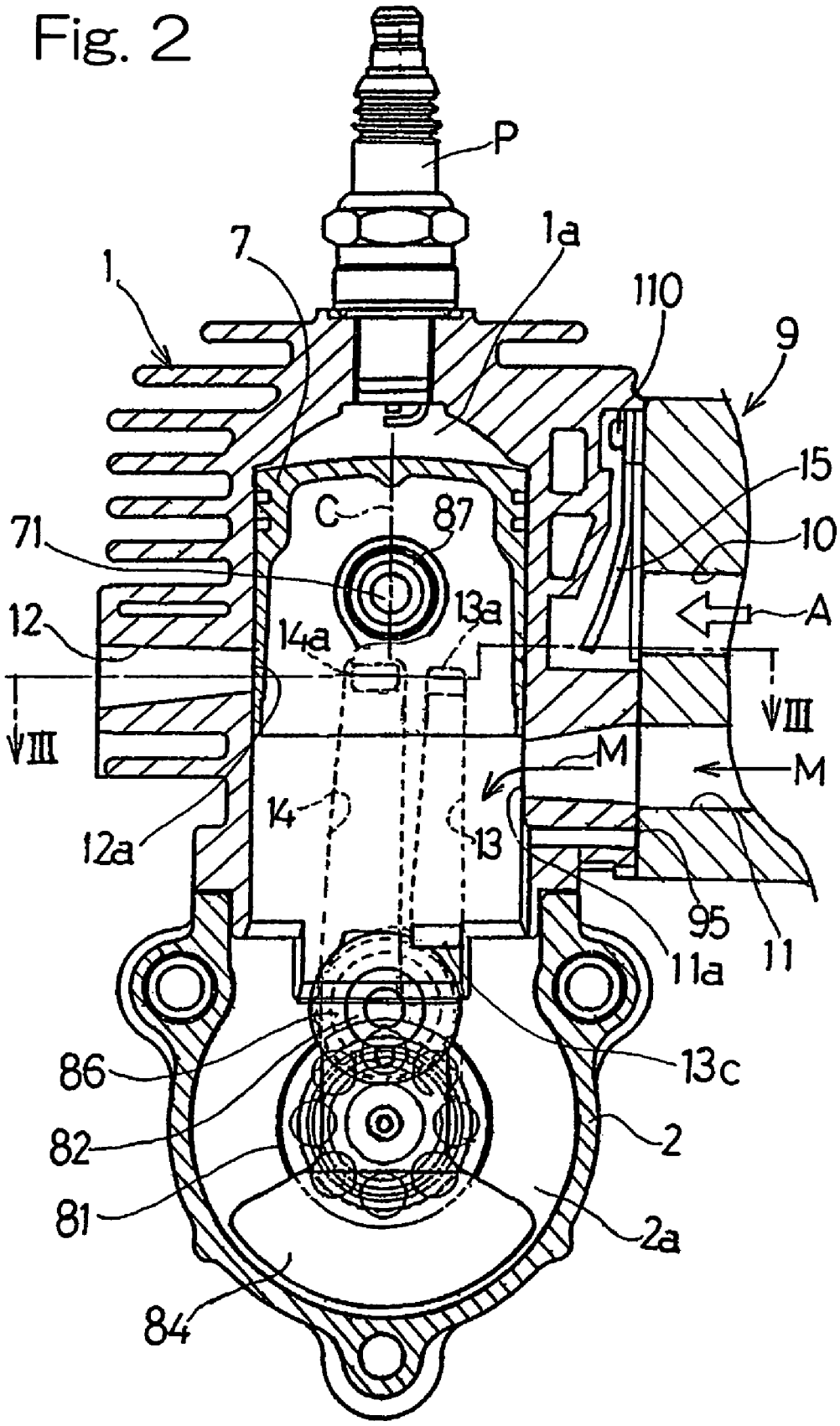
FIG. 2 is an elevational view in section, on an enlarged scale, of the two-cycle internal combustion engine, showing an engine cylinder and a crankcase.
Figure 4:
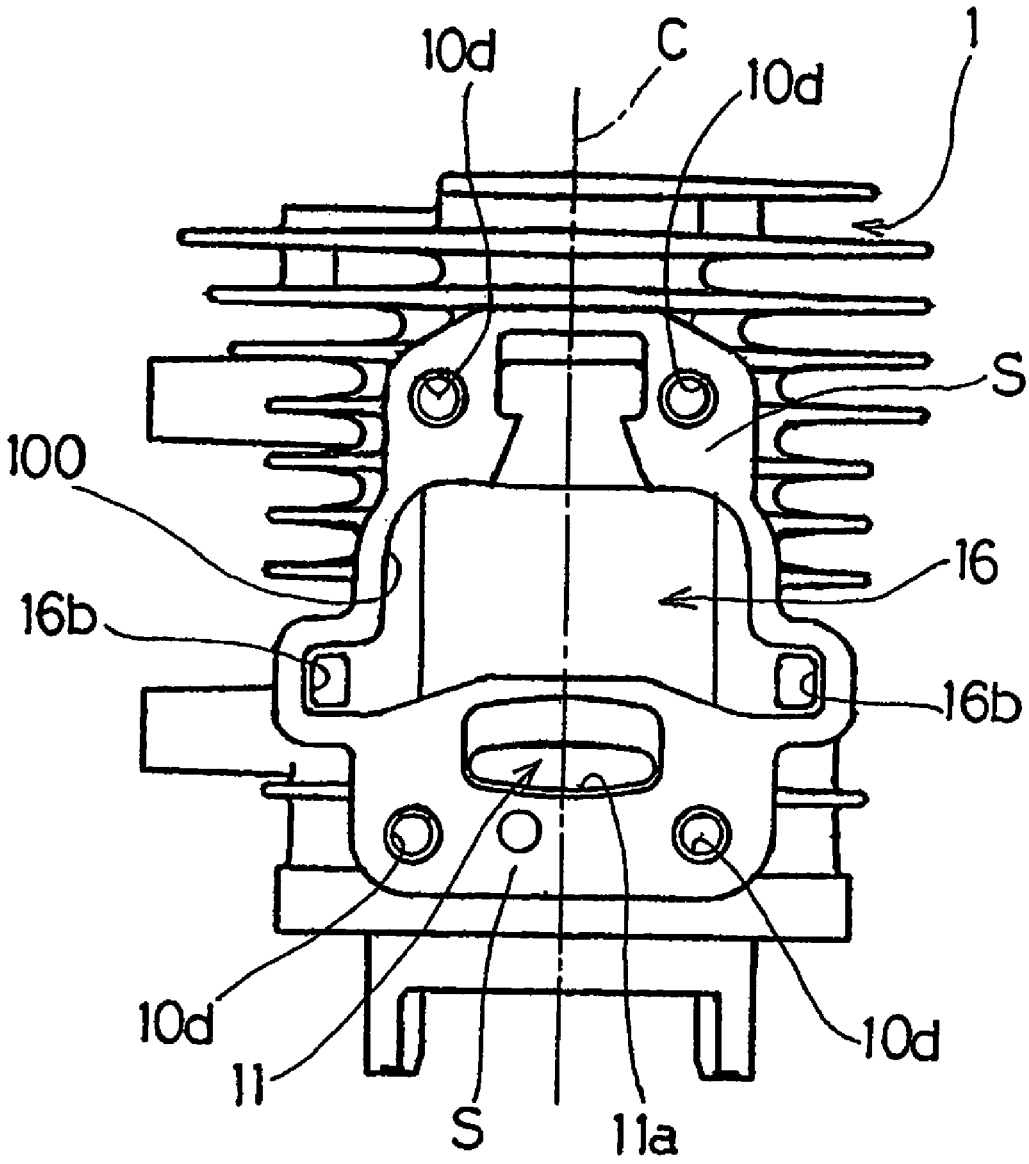
FIG. 4 is a side view of the two-cycle internal combustion engine, showing the details of the engine cylinder.

As best shown in FIG. 3 showing the cross-sectional view of the cylinder block 1 taken along line III—III in FIG. 2, the air introducing passage 16 referred to above is defined in the cylinder block 1 so as to extend in a direction substantially perpendicular to the longitudinal axis C of the cylinder block 1. This air introducing passage 16 serves to communicate the air supply passage 10 in the insulator 9 with the second scavenge passage 14. On the other hand, the insulator 9 is formed integrally with a protrusion 91 protruding into the cylinder block 1 and forming a part of the wall surface of the air introducing passage 16. Specifically, as shown in FIG. 4, the cylinder block 1 has a recess 100 defined therein so as to be depressed inwardly in a direction towards the exhaust port 12*a*, shown in FIG. 3, and parallel to the air supply passage 10 for defining the air introducing passage 16. The protrusion 91 integral with the insulator 9 as described above protrudes into this recess 100 to thereby define an upstream portion 16*a* of each of the air introducing passages 16. This recess 100 is preferably formed in together with or simultaneously with casting of the cylinder block 1 by the utilization of the metal casting technique.

A downstream portion 16*b* of the air introducing passage 16 is defined by a deeper region of the recess 100, occuping a position radially outwardly of the first scavenge passage 13 before it terminates in communication with the second scavenge passage 14. In other words, the recess 100 forms respective parts of, or the entirety of, the air introducing passage 16 over the entire distance of the air introducing passages 16 along which air flows.

Figure 8:
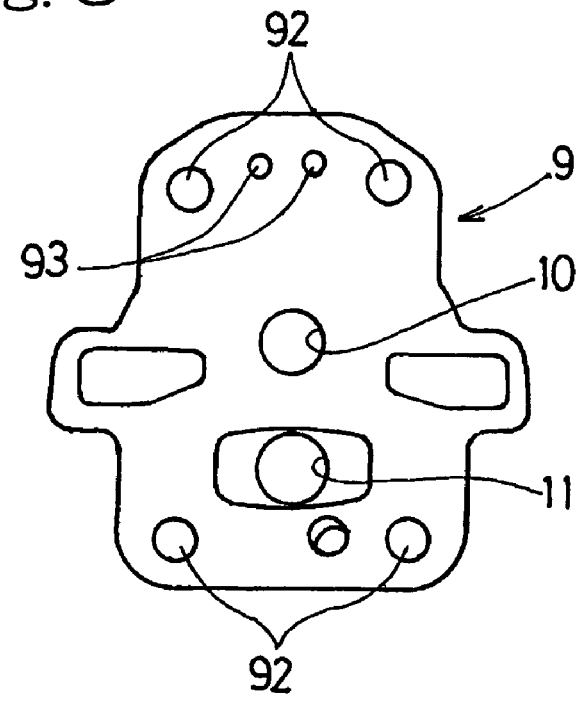
FIG. 8 is a rear elevational view showing an insulator as viewed from a fitting side of the insulator to the engine cylinder.

In addition to the air supply passage 10 and the air-fuel mixture supply passage 11, as best shown in FIG. 8, the insulator 9 is also formed with mounting holes 92 defined in four corner areas thereof for use in mounting the insulator 9 to the cylinder block 1 and two fitting holes 93 for use in fitting a reed valve, as will be described later, to the insulator 9. It is to be noted that a transverse width of the air-fuel mixture supply passage 11 progressively increases in a direction downstream thereof with respect to the direction of flow of the air-fuel mixture therethrough.

Figure 9A:
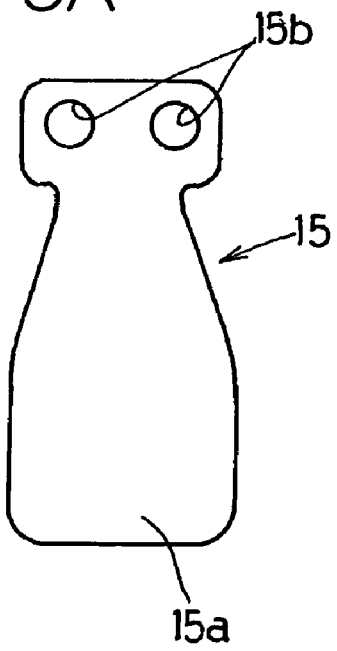
FIG. 9A is a front elevational view of a reed valve employed in the two-stroke internal combustion engine.
Figure 9B:
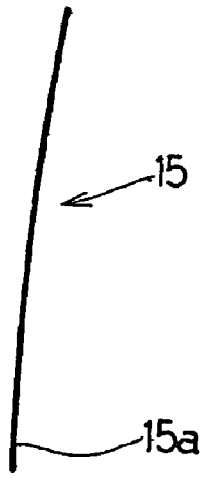
FIG. 9B is a side view of the reed valve shown in FIG. 9A.

A downstream outlet of the air supply passage 10 defined in the insulator 9 shown in FIG. 3 has the reed valve 15 fitted thereto so that the air supply passage 10 can be opened in the event that the pressure inside the air introducing passage 16 attains a value equal to or lower than a predetermined value. This reed valve 15 has, as shown in, for example, FIG. 9, a selective open/close area 15*a* defined at one end thereof for selectively opening and closing the air supply passage 10 (FIG. 3), and fitting holes 15*b* defined at the opposite end thereof and is fitted to the insulator 9 (FIG. 3), with the fitting holes 15*b* aligned with the fitting holes 93 (FIG. 8) in the insulator 9, by means of fastening members such as, for example, set screws 105 as shown in FIG. 3.

Figure 5:
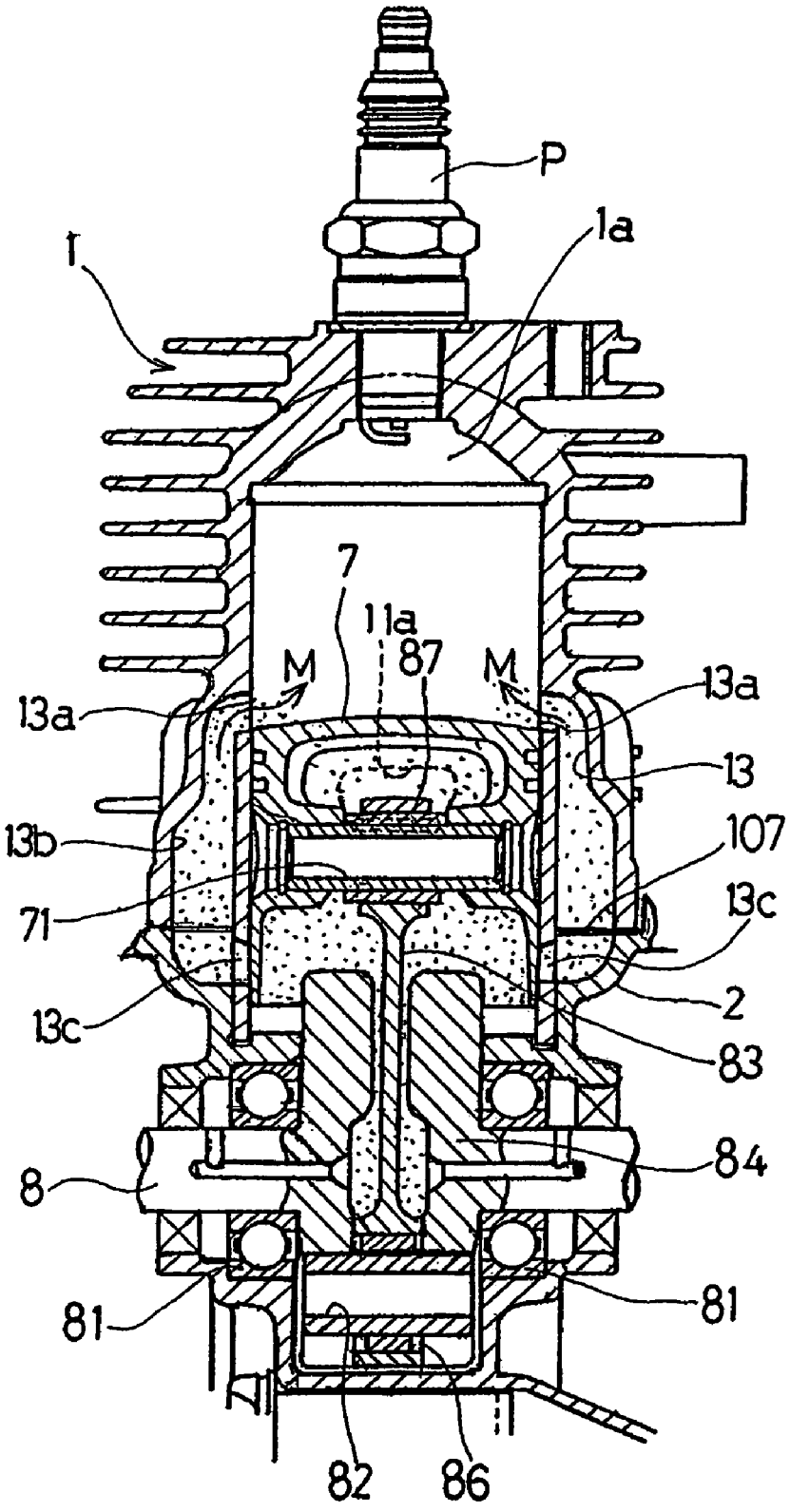
FIG. 5 is a cross-sectional view taken along line V—V in FIG. 3, showing a first scavenge passage.

Each first scavenge passage 13 best shown in FIG. 5 has defined therein a connecting passage portion 13*b* extending in a vertical direction from the first scavenge port 13*a* to an upper region of the crankcase 2 through a joint portion 107 between the cylinder block 1 and the crankcase 2, and an inflow port 13*c* open at the inner peripheral surface of the cylinder block 1. The air-fuel mixture M introduced into the crank chamber 2*a* through the air-fuel mixture supply passage 11 (FIG. 2) can be jetted from the first scavenge ports 13*a* into the combustion chamber 1*a* through the connecting passages 13*b* during the scavenge stroke in which the piston descends.

Figure 6:
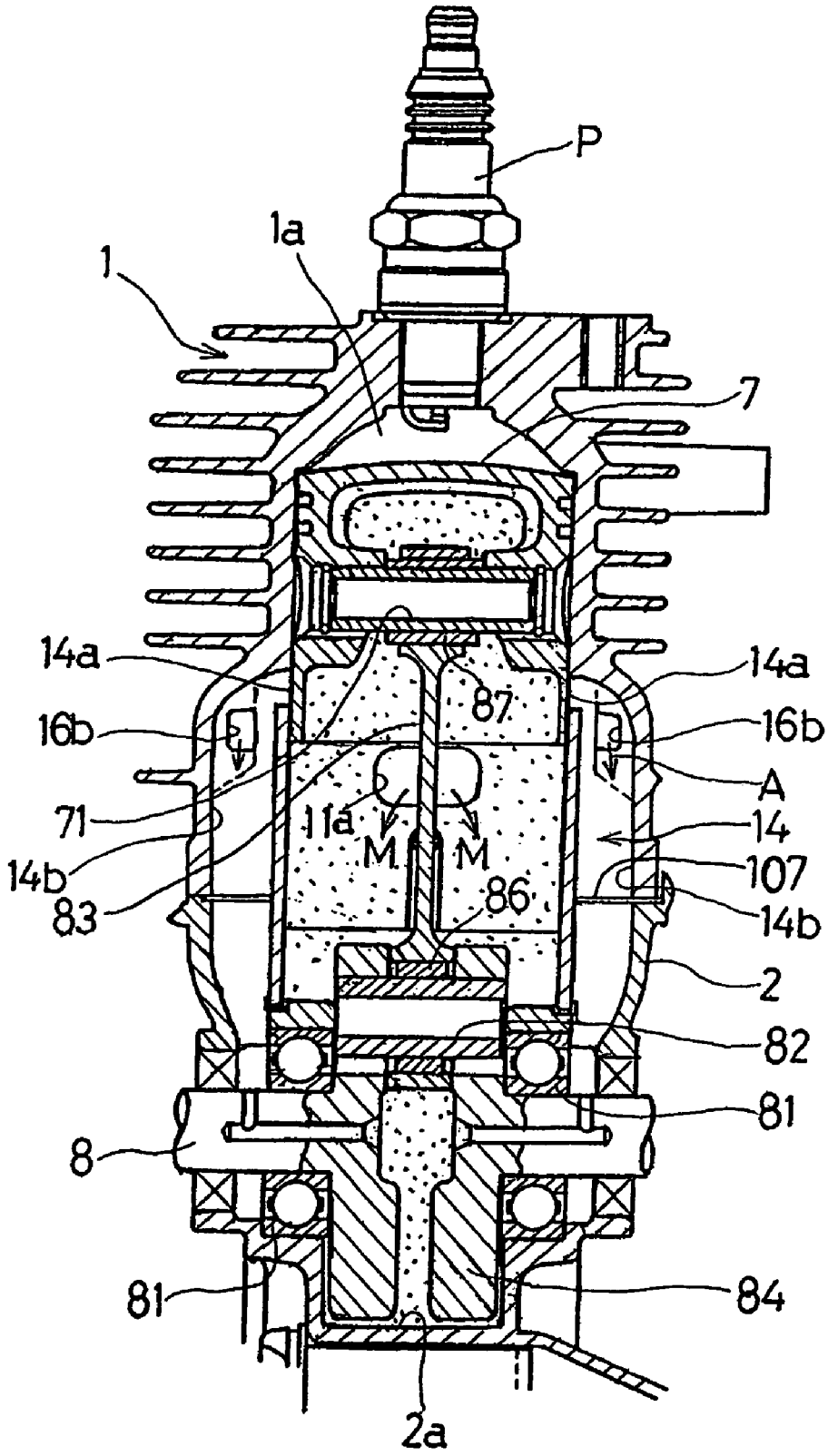
FIG. 6 is a cross-sectional view taken along line VI—VI in FIG. 3, showing a second scavenge passage.

On the other hand, as shown in FIG. 6, each second scavenge passage 14 has defined therein a connecting passage portion 14*b* extending in a vertical direction from the second scavenge port 14*a* to an outer side face of one of the crankshaft bearing 81, which is held at a level generally intermediate of the height of the crankcase 2, through the joint portion 107 between the cylinder block 1 and the crankcase 2. A lower end of the connecting passage portion 14*b* is communicated with the crank chamber 2*a* through a radial gap between inner and outer races of the crankshaft bearing 81 and also through an axial gap between the crank web 84 and the crankshaft bearing 81. The air A introduced from the air supply passage 10, shown in FIG. 3, into the second scavenge passages 14 can be jetted from the second scavenge ports 14*a* into the combustion chamber 1*a* through the connecting passage portions 14*b* during the scavenge stroke in which the piston 7 descends.

As can readily be understood from FIG. 4, a downstream portion of the air-fuel mixture supply passage 11 is defined at a location below the recess 100 open at an outer side surface portion of the cylinder block 1, with its outlet defining the air-fuel mixture supply port 11*a* open at the inner peripheral surface of the cylinder block 1. That outer side surface portion of the cylinder block 1, where the recess 100 and the air-fuel mixture supply passage 11 open, is formed with a flat mounting seat S to which one end face of the insulator 9, shown in FIG. 8, having a contour substantially identical with that of the flat mounting seat S, is secured through the gasket 95 (FIG. 3) in tight contact therewith. To secure the insulator 9 (FIG. 3) externally to the cylinder block 1, screw members are passed through the fitting holes 93 in the insulator 9 and are then tightly threaded into respective threaded holes 10*d* defined in the cylinder block 1 as shown in FIG. 4.

The operation of the two-cycle internal combustion engine of the structure described hereinbefore will now be described.

Assuming that the piston 7 moving upwardly within the cylinder block 1 during the intake and compression stroke approaches the top dead center as shown in FIG. 6 with a negative pressure consequently developed within the crank chamber 2*a*, the air-fuel mixture M is introduced directly into the crank chamber 2*a* through the air-fuel mixture supply port 11*a* open at the inner peripheral surface of the cylinder block 1. The air-fuel mixture M so introduced into the crank chamber 2*a* lubricates the bearings 86 and 87 at the big and small ends of the connecting rod 83. At the same time, the negative pressure is similarly developed not only within the second scavenge passages 14 communicating with the crank chamber 2*a* through the bearings 81 but also within the air introducing passage 16 communicating with the second scavenge passage 14 in FIG. 3. Therefore, the reed valve 15 fitted to the outlet of the air supply passage 10 in the insulator 9 is opened to allow the air A within the air supply passage 10 to be once introduced into the second scavenge passages 14 through the air introducing passage 16. Thus, when the reed valve 15 is opened by the effect of the negative pressure within the crank chamber 2*a* shown in FIG. 2 during the intake and compression stroke, the air A is at all times introduced into the second scavenge passages 14. Because of this, a sufficient amount of air necessary to prevent the blow-off of the air-fuel mixture M can be secured within the second scavenge passages 14.

Figure 7:
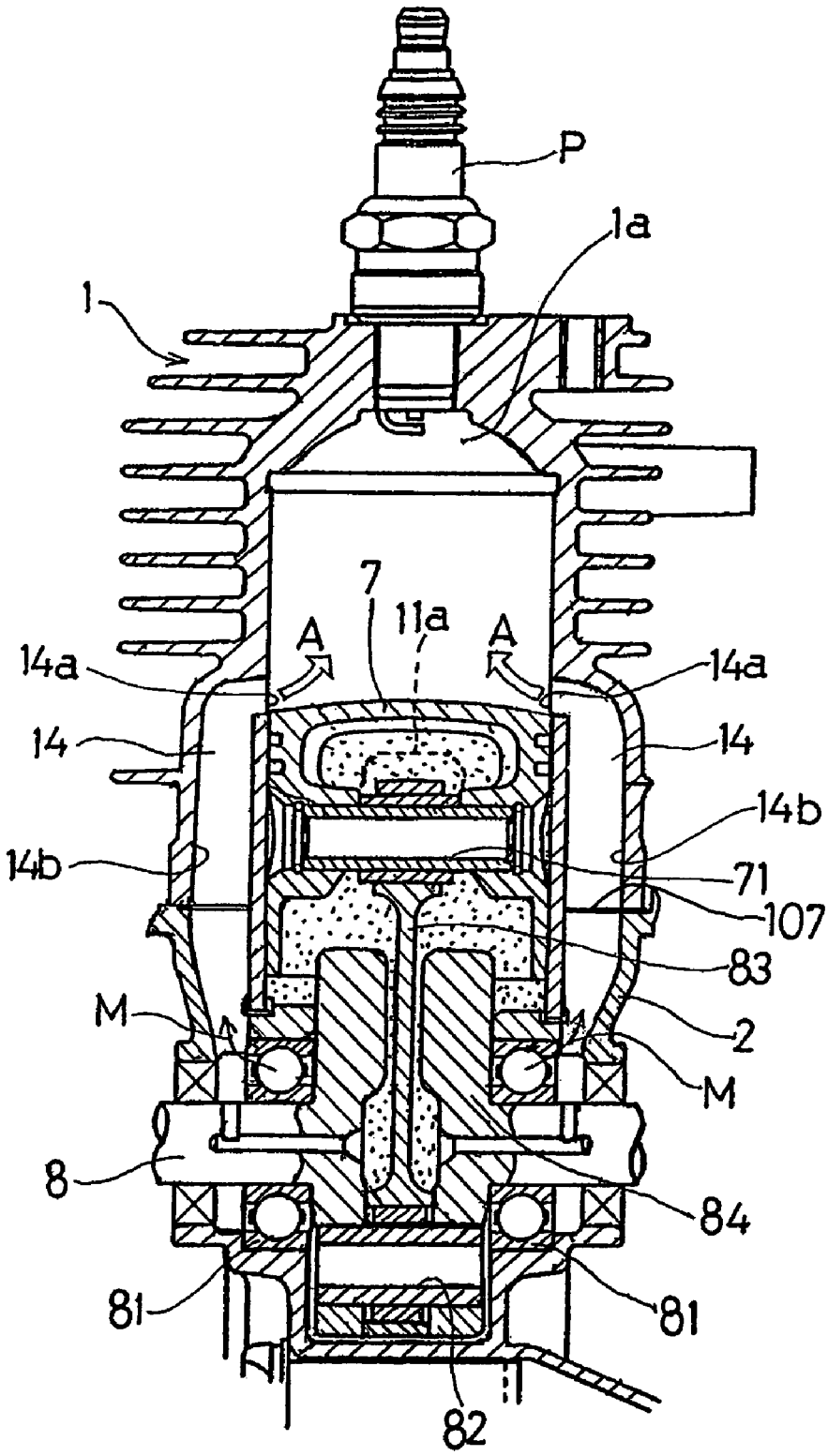
FIG. 7 is an elevational view in section, on an enlarged scale, of the two-cycle internal combustion engine.

During the subsequent scavenge stroke after an explosion and expansion stroke, as shown in FIG. 3, the air-fuel mixture M and the air A are introduced into the combustion chamber 1*a* through the first and second scavenge ports 13*a* and 14*a* communicated respectively with the first and second scavenge passages 13 and 14. More specifically, the air A is first introduced into the combustion chamber 1*a* through the second scavenge ports 14*a*, followed by introduction of the air-fuel mixture M into the combustion chamber 1*a* through the first scavenge port 13*a*. In view of an advanced supply of the air A and a slight delay in supply of the air-fuel mixture M into the combustion chamber 1*a* and since the air A is introduced into the combustion chamber 1*a* at a location nearer to the exhaust port 12*a* than the air-fuel mixture M is, the blow-off of the air-fuel mixture M from the exhaust port 12*a* can be effectively avoided by the action of the air A introduced earlier than the air-fuel mixture M. Also, as shown in FIG. 7, since a portion of the air-fuel mixture M within the crank chamber 2*a* is introduced into the second scavenge passages 14 through the gap between the inner and outer races of the crankshaft bearings 81 when the air A is introduced into the combustion chamber 1*a* through the second scavenge passages 14, the crankshaft bearings 81 can be effectively lubricated with fuel or oil contained in that portion of the air-fuel mixture M.

According to the foregoing embodiment of the present invention, since the air introducing passage 16 for communicating the supply passage 10 shown in FIG. 3 with the second scavenge passages 14 is so formed as to occupy a position radially outwardly of the first scavenge passages 13 in the cylinder block 1, any connecting tube and clamps hitherto required in the conventional two-stroke combustion engine are no longer necessary and, therefore, the number of component parts and the number of assembling steps can be reduced advantageously. Also, since the air introducing passage 16 is defined by the recess 100 formed simultaneously with casting of the cylinder block 1 and the protrusion 91 integral with the insulator 9, the recess 100 in the cylinder block can easily be formed with the use of a casting mold of a simplified shape, resulting in the manufacturing cost lowered.

In addition, since the recess 100 left by casting of the cylinder block 1 so that the air introducing passage 16 can be formed is narrowed in space by the protrusion 91 integral with the insulator 9, that is embedded within such recess 100 when the insulator 9 is fitted to the cylinder block 1, and, therefore, the substantial capacity of the crank chamber 2*a* (FIG. 2) communicated with the recess 100 can be in effect reduced, it is possible to secure a sufficient pressure under which the air A can be jetted during the scavenge stroke.

The two-cycle internal combustion engine according to a second preferred embodiment of the present invention will now be described with reference to FIGS. 10 to 12.

Figure 10:
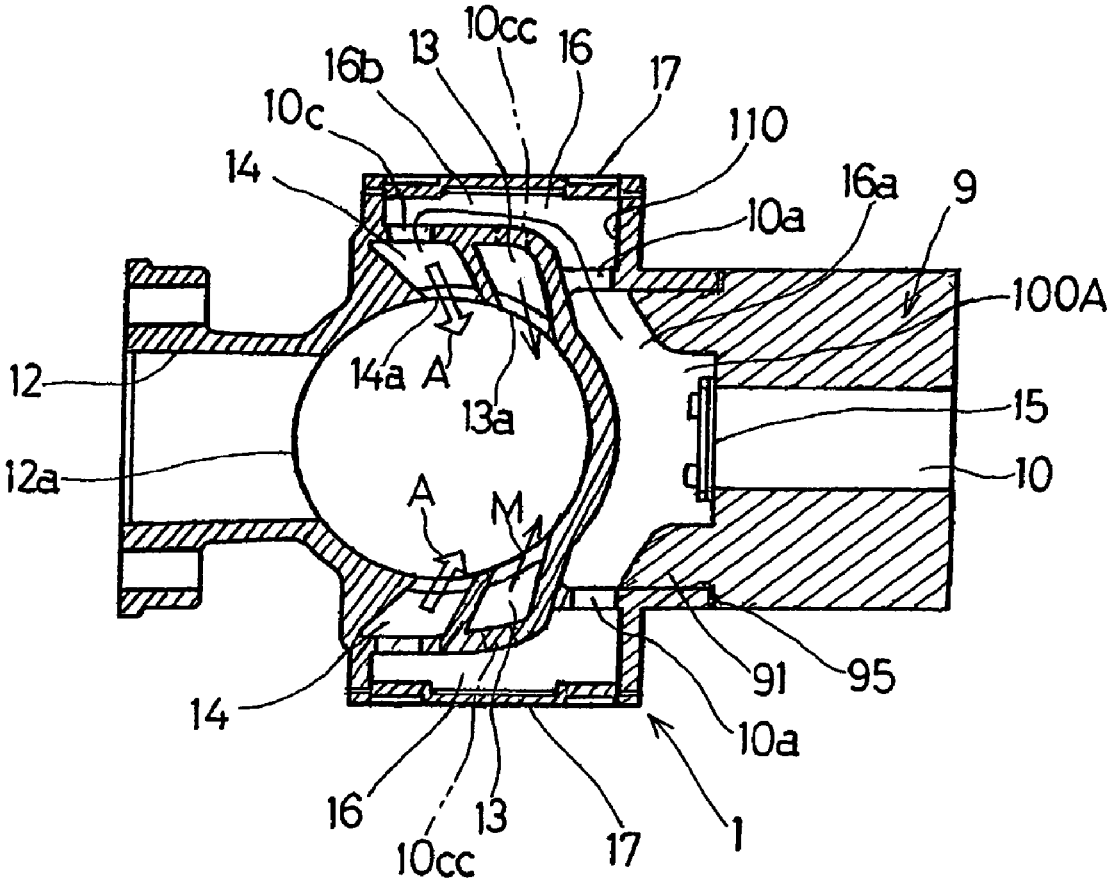
FIG. 10 is a view similar to FIG. 3, showing a portion of a two-cycle internal combustion engine according to a second preferred embodiment of the present invention.
Figure 11:
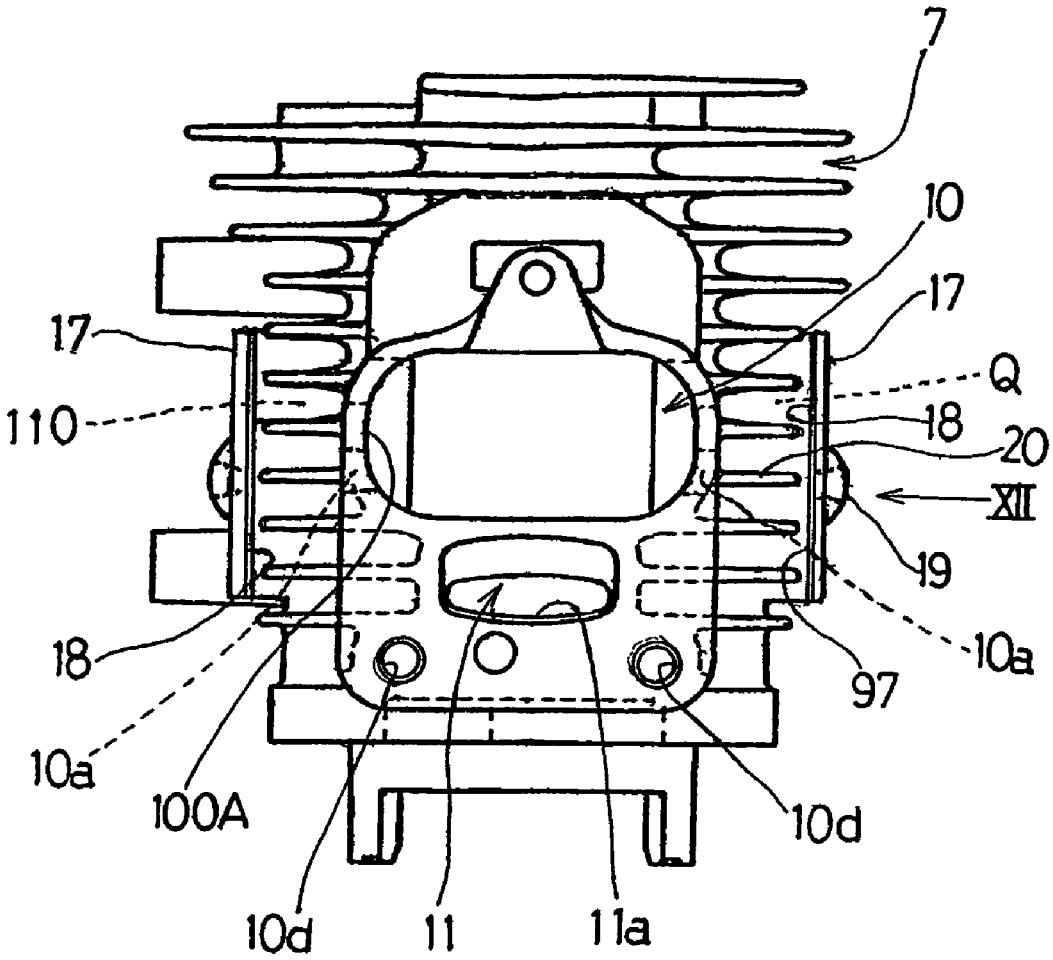
FIG. 11 is a side view showing a engine cylinder of the two-cycle internal combustion engine shown in FIG. 10.
Figure 12:
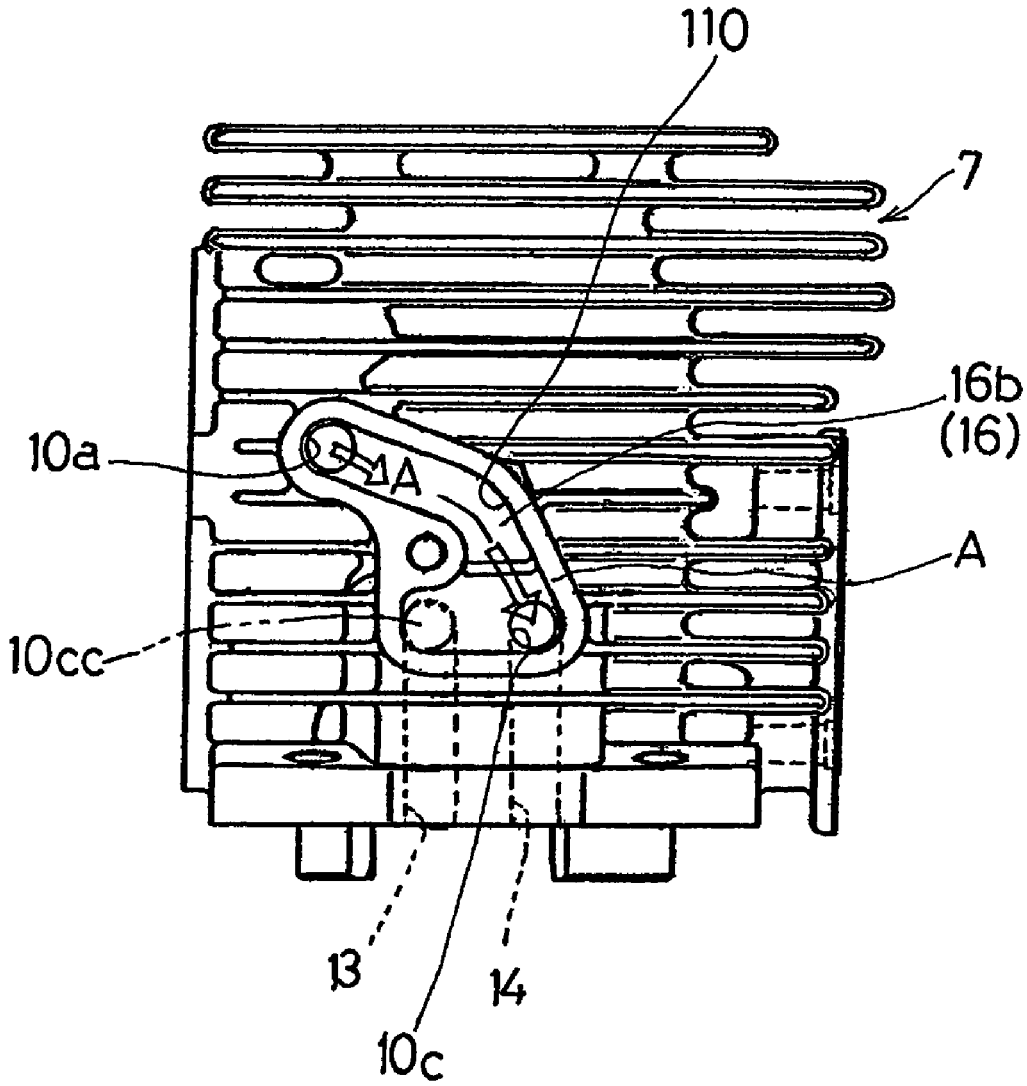
FIG. 12 is a side view of the engine cylinder shown in FIG. 11, as viewed in a direction conforming to arrow XII shown therein.

The two-cycle internal combustion engine shown in FIGS. 10 to 12 is substantially similar to that shown in and described with reference to FIGS. 1 to 9B, except that in addition to the use of the insulator 9 formed integrally with the protrusion 91 protruding into the cylinder block 1 so as to define that portion of the wall surface of the air introducing passage 16, such as employed in the foregoing embodiment, the use is made, as best shown in FIG. 10, of lid members 17 each fitted to the cylinder block 1 so as to define another portion of the wall surface of the air introducing passage 16.

According to the second embodiment of the present invention, the cylinder block 1 includes a first recess 100A communicating with the air supply passage 10 through the reed valve 15, and a second recess 110 defined at a location radially outwardly of the cylinder bore of the cylinder block 1 and laterally outwardly of each pair of the first and second scavenge passages 13 and 14 so as to open laterally outwardly. The lateral opening of each of the second recesses 110 is in turn closed by the respective lid member 17 to thereby define the downstream portion 16*b* of the air introducing passage 16. Accordingly, the air A supplied through the air supply passage 10 can be introduced into the second scavenge passages 14 through the air introducing passage 16 and then through air introducing ports 10*c* during opening of the reed valve 15. The upstream and downstream portions 16*a* and 16*b* of the air introducing passage 16 are communicated with each other through connecting passages or holes 10*a* defined in the cylinder block 1. Flow of each of the air A and the air-fuel mixture M during the intake and compression stroke and also during the scavenge stroke is similar to that described in connection with the first embodiment of the present invention and, therefore, the details thereof are not herein reiterated for the sake of brevity.

As discussed above, since the first recess 100A for forming the upstream portion 16*a*, which opens outwardly of the cylinder block 1 for defining that portion of the air introducing passage 16, has a transverse width smaller than that of the recess 100 shown in FIG. 4 and employed in the first embodiment of the present invention. The lid members 17 are, as shown in FIG. 11, secured to front and rear side surface areas of the cylinder block 1 by means of respective pluralities of screw members 19. As compared with the recess 100 employed in the first embodiment shown in and described with reference to FIGS. 1 to 9B, the first recess 100A employed in this embodiment can have a relatively small capacity and, therefore, the number of air cooling fins 20 formed either side of the cylinder block 1 and adjacent the lid members 17 can advantageously be increased to thereby facilitate the cooling efficiency of the cylinder block 1.

FIG. 12 represents the cylinder block 1 as viewed in a direction shown by the arrow XII in FIG. 11, with the lid member 17 removed from the cylinder block 1. As shown therein, the second recesse 110 defined in the cylinder block 1 has, in addition to the connecting passage 10*a*, the air introducing port 10*c* defined therein in communication with the second scavenge passage 14 and a connecting portion between the connecting passage 10*a* and the air introducing port 10*c* defines the downstream portion 16*b* of the air introducing passage 16. Accordingly, the air A can be introduced from the connecting passage 10*a* into the second scavenge passage 14 through the downstream portion 16*b* of the air introducing passage 16 and then through the air introducing port 10*c*. In this way, over the entire distance of the air introducing passages 16 along which air flows, the first and second recesses 100A and 110 form respective portions of the inner surface of the air introducing passage 16.

It is to be noted that where as shown by the double-dotted lines a separate air introducing ports 10*cc* is employed for communicating between the first scavenge passage 13 and the air introducing passage 16, the air A can be introduced not only into the second scavenge passage 14, but also into the first scavenge passage 13. In such case, the air A can be jetted from the first scavenge passage 13 in FIG. 10, at an initial stage of jetting of the air-fuel mixture M and, therefore, the blow-off of the air-fuel mixture M can be further efficiently suppressed.

In the second embodiment of the present invention described hereinabove, the air introducing passage 16 is defined by the lid members 17 in cooperation with the second recess 110, formed together with or simultaneously with casting of the cylinder block 1, and the protrusion 91 integral with the insulator 9 in cooperation with the first recess 100A as described in connection with the first embodiment and, therefore, the second recess 110 for forming the downstream portion 16*b* of the air introducing passage 16, which is positioned laterally outwardly of the first scavenge passage 13 and radially outwardly of the cylinder bore of the cylinder block 1 can advantageously formed by the use of a mold of a simplified shape, resulting in minimization of the cost of the mold.

Figure 13:
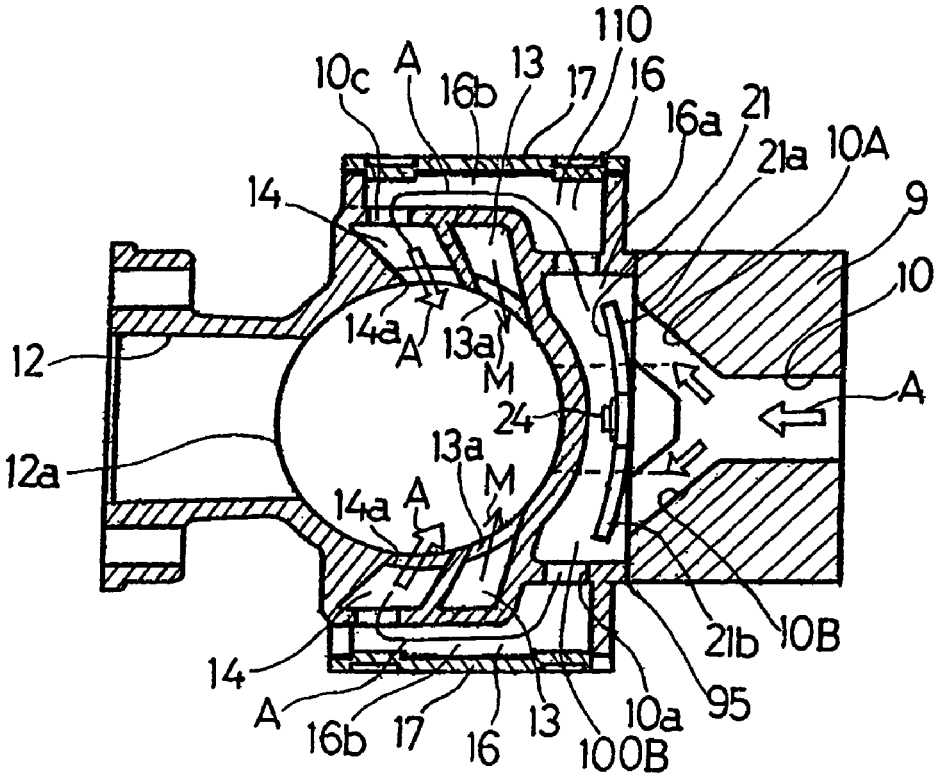
FIG. 13 is a view similar to FIG. 3, showing the engine cylinder of a two-cycle internal combustion engine according to a third preferred embodiment of the present invention.

Referring now to FIG. 13 illustrating a third preferred embodiment of the present invention, the insulator 9 employed therein is not formed with the protrusion 91 which has been shown and described in any one of the first and second embodiments. Instead of the provision of the protrusion 91, the downstream portion of the air supply passage 10 defined in the insulator 9 shown in FIG. 13 is ramified to provide a pair of branch passage portions 10A and 10B occuping left and positions, respectively. In the cylinder block 1 a first recess 100B communicating with the branch passage portions 10A and 10B is formed simultaneously with casting of the cylinder block 1.

Figure 14A:
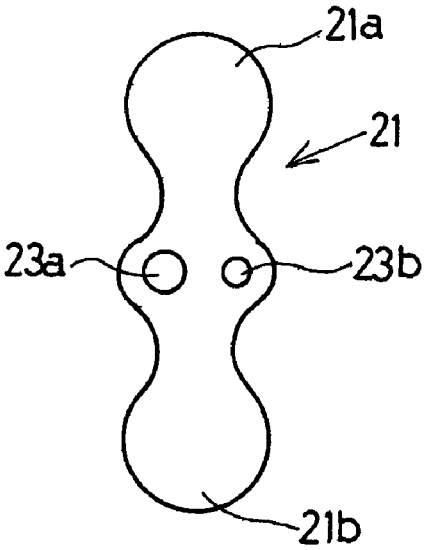
FIG. 14A is an elevational view of a reed valve employed in the third embodiment of the present invention.

As shown therein, as is the case with the second embodiment shown in and described with reference to FIGS. 10 to 12, the lid members 17 are fitted outwardly of the respective pairs of the first and second scavenge passages 13 and 14 to thereby define the downstream portions 16*b* of the air introducing passage 16 between the lid members 17 and the associated recesses 110. Outlet ends of the branch passage portions 10A and 10B in the insulator 9 are provided with a reed valve 21 of a structure which will now be described with reference to FIGS. 14A and 14B. As shown therein, the reed valve 21 is of a configuration including a pair of left and right selective open/close areas 21*a* and 21*b* adapted to selectively open and close the associated outlet ends of the branch passage portions 10A and 10B shown in FIG. 13.

Accordingly, during the intake and compression stroke in which the negative pressure is developed inside the air introducing passage 16, the left and right open/close areas 21*a* and 21*b* of the reed valve 21 are opened by the effect of such negative pressure to thereby allow the air A inside the air supply passage 10 to be introduced into the downstream portions 16*b* of the air introducing passage 16 through the branch passage portions 10A and 10B by way of the upstream portions 16*a*, each defined in and by the first recess 100B in the cylinder block 1, and then by way of the connecting passage 10*a* and subsequently into the second scavenge passages 14 through the air introducing ports 10*c*.

Figure 14B:
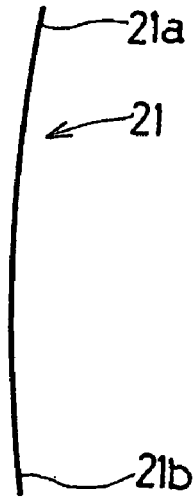
FIG. 14B is a side view of the reed valve shown in FIG. 14A.

It is to be noted that as shown in FIG. 14B, the reed valve 21 is formed with a fitting hole 23*a* and a knock pin hole 23*b* defined at a portion intermediate thereof and is secured to the insulator 9 by means of a screw member 24 passing through the fitting hole 23*a* and then threaded into the insulator 9.

The third embodiment shown in FIG. 13 differs from the second embodiment shown in FIGS. 10 to 12, in respect of the structure of the air supply passage 10 defined in the insulator and the shape of the reed valve 21, with the other structural features remaining identical with those of the second embodiments. Accordingly, except for the following point, the two-cycle internal combustion engine according to the third embodiment functions in a manner similar to that according to any one of the first and second embodiments. Specifically, in the case of the third embodiment, the reed valve 21 is operable to selectively open and close the branch passage portions 10A and 10B each having a relatively small cross-sectional surface area and, therefore, the stroke of movement performed in selectively opening and closing the branch passage portions 10A and 10B can be made small. Accordingly, the first recess 100B in the cylinder block 1, which is utilized to accommodate the reed valve 21, can have a relatively small depth, resulting in production of the combustion engine in a compact size.

Although the present invention has been fully described in connection with the preferred embodiments thereof with reference to the accompanying drawings which are used only for the purpose of illustration, those skilled in the art will readily conceive numerous changes and modifications within the framework of obviousness upon the reading of the specification herein presented of the present invention. Accordingly, such changes and modifications are, unless they depart from the scope of the present invention as delivered from the claims annexed hereto, to be construed as included therein.

What is claimed is:

1. A two-cycle combustion engine having an air scavenging system, which comprises:

a crankcase having a crank chamber defined;

an cylinder block defining therein a combustion chamber and mounted on the crankcase;

first and second scavenge passages each communicating between the combustion chamber and the crank chamber;

an air supply passage for supplying air;

an air introducing passage for introducing the air from the air supply passage towards the second scavenge passage;

a reed valve disposed in the air supply passage; and an air-fuel mixture supply passage for supplying an air-fuel mixture into the crank chamber, wherein the second scavenge passage is positioned at a location nearer to an exhaust port than the first scavenge passage and the air introducing passage is formed in the cylinder block so as to introduce the air from the air supply passage into the second scavenge passage by way of a radially outer portion of the first scavenge passage, wherein a recess defining the air introducing passage is formed in the cylinder block together with casting of the cylinder block, and wherein during an intake and compression stroke, the air from the air supply passage is introduced into the second scavenge passage through the reed valve and the air-fuel mixture from the air-fuel mixture supply passage is introduced into the crank chamber, and during a scavenge stroke, supply of the air within the second scavenge passage into the combustion chamber is initiated prior to initiation of supply of the air-fuel mixture within the crank chamber into the combustion chamber through the first scavenge passage.

2. The two-cycle combustion engine as claimed in claim 1, further comprising an insulator interposed between a carburetor and the cylinder block, said insulator being formed integrally with a protrusion extending into the recess in the cylinder block to define a portion of a wall surface of the air introducing passage.

3. The two-cycle combustion engine as claimed in claim 2, further comprising a lid member fitted to the cylinder block and forming a part of the wall surface of the air introducing passage.

4. The two-cycle combustion engine as claimed in claim 1, further comprising a carburetor and an insulator interposed between the carburetor and the cylinder block, wherein the insulator is formed with a pair of branch passages that define a downstream portion of the air supply passage, and the reed valve has a pair of selective open/close areas defined therein for selectively opening and closing the corresponding branch passages.

5. The two-cycle combustion engine as claimed in claim 1, wherein the second scavenge passage is fluid connected between the combustion chamber and the crank chamber through a bearing for a crankshaft mounted on the crankcase.

* * * * *